United States Patent [19]

Lincicome

[11] 4,227,444

[45] Oct. 14, 1980

[54] ANEROID BELLOWS ASSEMBLY

[75] Inventor: Thomas N. Lincicome, Elgin, Ill.

[73] Assignee: UOP Inc., Des Plaines, Ill.

[21] Appl. No.: 956,112

[22] Filed: Oct. 30, 1978

[51] Int. Cl.[3] ..... F01B 19/00; F16J 3/04

[52] U.S. Cl. ..... 92/40; 92/43; 128/204.29

[58] Field of Search ..... 92/34, 40, 94, 43, 85 A; 98/1-5; 128/204.29

[56] References Cited

U.S. PATENT DOCUMENTS

| | | | |
|---|---|---|---|
| 2,146,684 | 2/1939 | McLaughlin | 92/40 X |
| 2,411,796 | 11/1946 | Leupold | 92/40 X |
| 2,618,907 | 11/1952 | Pritchett | 92/40 X |
| 2,662,946 | 12/1953 | Schweiss | 92/40 X |
| 2,857,495 | 10/1958 | Bourns et al. | 92/40 X |
| 3,053,281 | 9/1962 | Taylor | 92/40 X |

*Primary Examiner*—Irwin C. Cohen

*Attorney, Agent, or Firm*—James R. Hoatson, Jr.; Barry L. Clark; William H. Page, II

[57] ABSTRACT

Aneroid bellows assembly utilized in the emergency oxygen supply systems of aircraft includes a leaf spring mounted at its center to an adjustably positioned end fitting located on the axis of an evacuated bellows spring. The outer edges of the leaf spring are engaged with an adjustable ring threadedly mounted on the outer rim of a tubular housing member in which the bellows spring is mounted. The adjustable end fitting and ring permit elements having a substantial size tolerance to be assembled together and readily adjusted to achieve precise calibration.

3 Claims, 8 Drawing Figures

ANEROID BELLOWS ASSEMBLY

BACKGROUND OF THE INVENTION

The invention relates to aneroid bellows assemblies of the type used in emergency oxygen systems in aircraft. In commercial aircraft, it is required that crew members wear oxygen masks at appropriate times and that oxygen be supplied in increasing amounts if the cabin pressure is reduced below the normally maintained pressure of 11.8 psia associated with an altitude of 6,000 feet. It is also required that the rate of flow of oxygen increase substantially at pressures of less than about 7.24 psia, which corresponds to an altitude of 18,000 feet.

Aneroid assemblies capable of controlling the flow of oxygen in the above manner have been sold for many years by Scott Aviation Corp. of Lancaster, New York. Typically, such devices have included an evacuated bellows spring mounted internally of an open ended tubular housing and affixed at one of its ends to the closed end of the housing. The bellows expands axially as ambient pressure decreases. An end plate attached to the free end of the bellows spring overlies the open end rim of the housing and extends radially outwardly of the housing where it is engaged by a coil spring which encircles the housing. It is important that the coil spring the deflected a precise distance in order to insure that the movable tip end of the bellows assembly will move as necessary to control the flow of oxygen in the manner desired. Usual manufacturing tolerances in the coil spring, housing and bellows portions of the assembly are much greater than those needed to assure proper functioning of the various parts after assembly and thus, it has been necessary to sort the parts by size and selectively fit them to each other or, alternatively, to remove material from one of them. Such operations are very time consuming and expensive.

SUMMARY OF THE INVENTION

It is among the objects of the present invention to provide an aneroid bellows assembly which is much easier to assemble and calibrate than previously available units and which is also slightly more compact and lighter in weight. In the assembly of the invention, the housing end plates and the large coil spring of the prior art assembly are eliminated and replaced by a small, lightweight leaf spring and a threaded housing end adjustment ring. The adjustment ring cooperates with an adjustable leaf spring mount on the free end of the bellows spring to accommodate a large range of manufacturing tolerances in the respective parts and permit rapid and simple calibration.

DESCRIPTION OF THE PREFERRED EMBODIMENT

Figure 1:
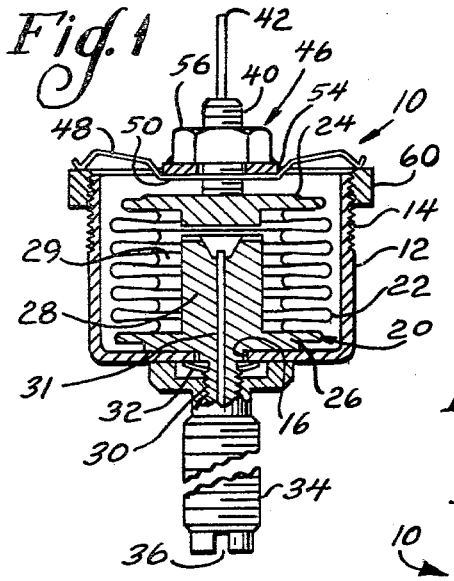
FIG. 1 is an axial section view of the aneroid bellows assembly of the invention at sea level.
Figure 3:
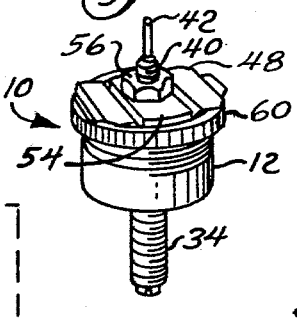
FIG. 3 is a perspective view of the assembly of FIG. 1.

Referring to the drawings, my improved aneroid bellows assembly is shown in is finally assembled and adjusted sea level position in FIG. 1 where the parts are shown in partial axial cross-section and in FIG. 3 where they are shown in perspective. Referring particularly to FIG. 1, the aneroid assembly 10 can be seen as including a tubular can or housing member 12 having an outer threaded end portion 14 at its upper end and an axially aligned opening 16 at its lower end. A bellows assembly indicated generally at 20 is mounted within the housing 12 and the opening 16. The bellows assembly 20 includes a bellows spring member 22 which is evacuated and closed at its upper end by an upper end plate 24 and at its lower end by a lower end plate 26. The lower end plate includes a lower abutment portion 28 which extends into the hollow interior chamber 29 of the bellows and limits the extent to which the bellows 22 may be compressed when it is evacuated. A threaded retaining portion 30 extends downwardly from the lower end plate 26 and has an evacuation tube 31 passing through its center. The lower end (not shown) of the evacuation tube 31 is compressed, cut off and soldered closed during the course of the chamber 29. A retaining ring member 32 anchors the threaded portion 30 of the bellows assembly 20 to the housing 12. After the ring 32 is assembled, an adjustable mounting shaft 34 is screwed onto the threaded portion 30 and into firm engagement with the housing 12. An adjustment slot 36, which is adapted to receive a screw driver blade is formed at the lower end of the threaded shaft 34 and permits the entire assembly 10 to be vertically, adjustably positioned in an external mounting plate (not shown). Extending upwardly from the upper end plate 24 of the bellows assembly 20 is a bellows adjustment screw 40 having an actuator tip portion 42 which controls the flow of oxygen in a device (not shown) with which the assembly 10 is used. A bellows nut assembly 46 is threaded onto the adjustment screw 40 and comprises a generally flat leaf spring portion 48 which has a recessed center portion 50 and bent end portions 52. A flat end plate member 54 is mounted in the recessed area 50 and brazed thereto as well as to an adjustment nut 56 which has threads which are complementary to those on bellows adjustment screw 40. The end plate 54 is shown as resting on the housing 12 so that the bottom end portions of the end plate 54 overlie and contact the upper end surface of the housing 12. The bent ends 52 of the leaf spring 48 are shown as resting on a rotatable adjustment ring 60 which is threadedly engaged with the threaded end portion 14 of the housing 12. Since the assembly 10 is shown in its sea level position, one can readily appreciate that the ambient pressure in combination with the vacuum within the chamber 29 is exerting a downward force on the adjustment screw 40 and the nut assembly 46 carried thereby so that the end plate 54 will bear on the housing 12 with a predetermined amount of preload force. This preload force can be increased or decreased by rotating the nut 56 so as to reduce or enlarge the space between the central portion of the leaf spring 48 and the upper portion of the end plate 24, respectively. An additional preload is placed on the bellows assembly 20 by the leaf spring 48 which is shown as being biased to a loaded position by the adjustment ring 60.

Figure 8:
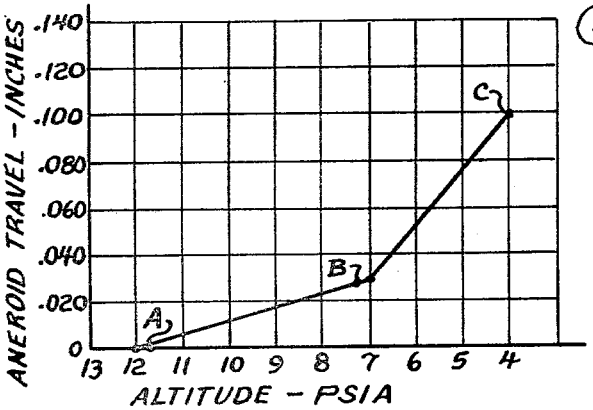
FIG. 8 is a graph illustrating the amount of bellows movement which is produced by the assembly of FIG. 1 for various degrees of absolute pressure corresponding to different altitudes.
Figure 7:
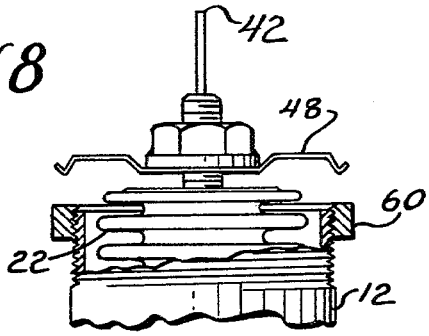
FIG. 7 is a view of the bellows assembly of FIG. 1 when subjected to a vacuum of 3.98 psia, corresponding to an altitude of 32,000 feet.

Before proceeding further to describe the manner in which the assembly 10 is calibrated, it would be well to briefly describe the use of the device. This can be best done in connection with FIG. 8 wherein a graph is illustrated plotting the inches of aneroid travel versus altitude as expressed in absolute pressure. It is well known that the absolute pressure of the atmosphere varies from 14.7 psia. at sea level to about 3.98 at 32,000 feet. It is also known that no supplemental oxygen is required at an altitude of 6,000 feet where the pressure is 11.8 psia. but that a steadily increasing amount of oxygen is required as one goes up in the atmosphere from 6,000 feet to about 18,000 feet where the pressure is 7.24 psia. As one goes above 18,000 feet, the rate at which oxygen must be supplied is much higher than at lower altitudes. In attempting to closely approximate the non-linear manner (not shown) in which oxygen should ideally be supplied, it has been determined that the straight line curves A-B and B-C in FIG. 8 are quite satisfactory and can be achieved by combining two springs which have different spring rates. It has been found that the use of a bellows spring 22 having a spring rate of 10.1 pounds per inch and a leaf spring having a spring rate of 34 pounds per inch will provide satisfactory results when the device is correctly assembled and preloaded. To correlate FIGS. 1 and 8, it can be noted that the aneroid tip 42 will move outwardly relative to the housing 12 by the approximately 0.030" distance between points A and B as a lowering of the ambient pressure from 11.8 to 7.24 psia. permits the bellows 22 to expand and remove the preloading of the leaf spring 48. Once the effect of the leaf spring is removed, the bellows 22 can expand at a much more rapid rate so that tip 42 will move the approximately 0.070" distance between points B and C as the ambient pressure decreases from 7.24 to 3.98 psia. The configuration of the assembly at 3.98 psia. is shown in FIG. 7.

Figure 4:
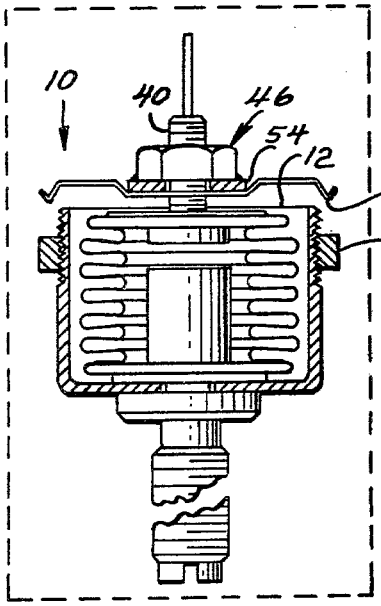
FIG. 4 is an axial section view illustrating the positioning of the leaf spring relative to the housing in a vacuum of 7.24 psia.
Figure 5:
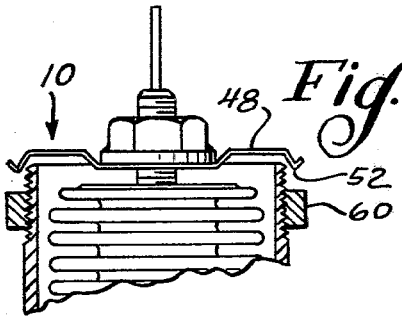
FIG. 5 is a view of the assembly of FIG. 4 after the vacuum is removed.
Figure 6:
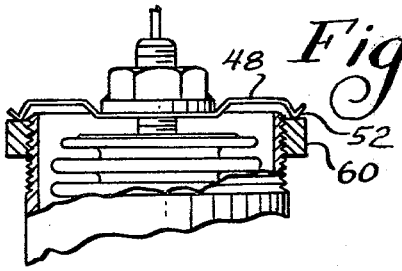
FIG. 6 is a view of the assembly of FIG. 5 after the ring has been threaded upwardly into touching contact with the leaf spring.

To properly calibrate the bellows assembly 10 to produce the travel shown in FIG. 8, the assembly is placed in a test chamber having a pressure of 7.24 psia., as symbolized by the dotted lines in FIG. 4. The bellows nut assembly 46 is screwed along the shaft 40 until end plate 54 is 0.030" above the end surface of the housing 12. The adjusting ring 60 is backed off, as shown, so that when the device is removed from the vacuum it will assume the configuration shown in FIG. 5. The ring 60 is then threaded up to the FIG. 6 position where it exactly meets the ends 52 of the leaf spring 48. The ring 60 is then threaded upwardly another 0.030" to preload the spring 48 to the configuration shown in FIG. 1.

Figure 2:
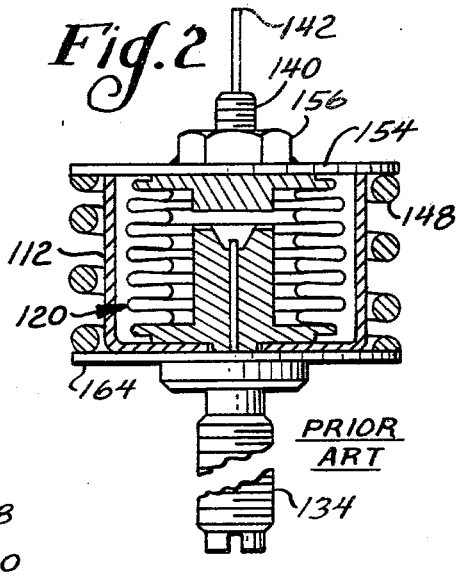
FIG. 2 is an axial section view of a prior art bellows assembly at sea level.

From the preceding discussion, the advantages of my improved aneroid bellows assembly over prior art devices such as that shown in FIG. 2 will be readily evident. The latter embodiment has elements 112, 120, 134, 140, 142, 148, 154 and 156 which correspond to similar elements 12, 20, 34, 40, 42, 48, 54 and 56 in FIG. 1. As seen in FIG. 2, element 164 is a retaining plate which functions as a radial extension of the bottom of the housing 112 and cooperates with the plate 154 affixed to nut 156 to compress the coil spring 148. As previously noted, the usual manufacturing tolerances for the spring 148, the housing 112 and the bellows 120 are much greater than those needed to assure proper functioning of the parts after assembly, thus making it necessary to spend much time and money to sort the parts by size and selectively fit them to reach each other or, alternatively, to remove material from one of them.

I claim as my invention:

1. An aneroid bellows assembly for use in automatically controlling the flow of emergency oxygen in an aircraft cabin when pressurization is lost at varying altitudes comprising an open ended tubular housing member having a hermetically sealed, evacuated bellows spring mounted therein; said bellows having a threaded adjustment member integrally attached thereto and extending axially thereof beyond the open end of said housing member, said adjustment member having a tip portion on its outer end which is adapted to move axially with variations in cabin pressure and is adapted to control the flow of oxygen from a source thereof and a bellows adjustment nut assembly threadedly mounted thereon; said nut assembly including a leaf spring member integrally attached thereto and extending on opposite sides of the bellows axis and generally normal thereto, the ends of said leaf spring member being in engagement with and normally deflected by a spring adjustment ring which is externally threadedly mounted on the open end portion of said tubular housing adjacent the open end thereof.

2. The aneroid bellows assembly of claim 1 wherein the spring rate of the leaf spring member is greater than that of the bellows but the leaf spring has a lesser amount of deflection so that the tip portion will move at least about twice as much when subjected to changes in the absolute pressure corresponding to change in altitude from about 18000–32000 feet as when subjected to changes in the absolute pressure corresponding to changes in altitude from about 6000–18000 feet.

3. The aneroid bellows assembly of claim 2 wherein said spring adjustment ring has internal threads which are threaded onto external threads on the outer end portion of said tubular housing member, said nut assembly and said adjustment ring contacting the center and ends, respectively, of said leaf spring member and determining the deflection of said leaf spring member.

* * * * *